US007509902B2

(12) United States Patent
Weber

(10) Patent No.: US 7,509,902 B2
(45) Date of Patent: Mar. 31, 2009

(54) DEVICE FOR SLICING FOOD PRODUCTS

(75) Inventor: Gunther Weber, Zachow (DE)

(73) Assignee: Weber Maschinenbau GmbH & Co. KG, Breidenbach (DE)

( * ) Notice: Subject to any disclaimer, the term of this patent is extended or adjusted under 35 U.S.C. 154(b) by 731 days.

(21) Appl. No.: 10/491,388

(22) PCT Filed: Sep. 10, 2002

(86) PCT No.: PCT/EP02/10149

§ 371 (c)(1),
(2), (4) Date: Mar. 31, 2004

(87) PCT Pub. No.: WO03/031126

PCT Pub. Date: Apr. 17, 2003

(65) Prior Publication Data

US 2005/0072322 A1 Apr. 7, 2005

(30) Foreign Application Priority Data

Oct. 2, 2001 (DE) ..... 101 48 595

(51) Int. Cl.
*B26D 1/25* (2006.01)

(52) U.S. Cl. ..... 83/596; 83/932; 83/698.61

(58) Field of Classification Search ..... 83/486, 83/932, 490, 745, 777, 783, 602, 613, 596, 83/698.51, 698.61; 99/538
See application file for complete search history.

(56) References Cited

U.S. PATENT DOCUMENTS

| | | | | |
|---|---|---|---|---|
| 1,550,520 | A * | 8/1925 | Drucker | 83/486 |
| 2,317,568 | A * | 4/1943 | Wallace et al. | 83/471.2 |
| 3,374,813 | A * | 3/1968 | Tillery | 83/120 |
| 3,413,881 | A * | 12/1968 | Stolzer | 83/486 |
| 4,523,501 | A * | 6/1985 | Mengel | 83/42 |
| 4,934,232 | A * | 6/1990 | Weber et al. | 83/355 |
| 5,241,887 | A | 9/1993 | Wolff et al. | 83/401 |
| 5,666,868 | A * | 9/1997 | Diete et al. | 83/168 |
| 6,272,958 | B1 * | 8/2001 | Abler et al. | 83/23 |
| 6,318,224 | B1 * | 11/2001 | Hoyland | 83/23 |
| 6,640,681 | B1 * | 11/2003 | Weber | 83/27 |
| 6,758,133 | B2 * | 7/2004 | Weber | 99/538 |
| 7,207,673 | B1 | 4/2007 | Ho | |

FOREIGN PATENT DOCUMENTS

| | | |
|---|---|---|
| DE | 37 14810 | 6/1990 |
| DE | 42 14 264 | 11/1993 |
| DE | 195 06 649 | 2/1996 |
| DE | 195 18 597 | 11/1996 |
| DE | 199 17 536 | 10/2000 |
| EP | 0 867 263 | 9/1998 |

(Continued)

*Primary Examiner*—Kenneth E. Peterson
*Assistant Examiner*—Phong Nguyen
(74) *Attorney, Agent, or Firm*—Gifford, Krass, Sprinkle, Anderson & Citkowski, P.C.

(57) ABSTRACT

An apparatus for slicing food products having a machine housing. A cutting head housing with a rotatably driven blade is bonded to the machine housing by an adjustment device. The adjustment device includes a frame which is only moveable in a Y direction relative to the machine housing while the cutting head housing is literally moveable in the X direction relative to the frame.

12 Claims, 1 Drawing Sheet

FOREIGN PATENT DOCUMENTS

| | | |
|---|---|---|
| EP | 1 020 260 | 7/2000 |
| JP | 61-071968 | 4/1986 |
| JP | 3-198 | 1/1991 |
| JP | 05-138592 | 6/1993 |
| JP | 05-138593 | 6/1993 |
| JP | 05-60795 | 8/1993 |
| JP | 05-72396 | 10/1993 |
| JP | 10-296682 | 11/1998 |

* cited by examiner

DEVICE FOR SLICING FOOD PRODUCTS

BACKGROUND OF THE INVENTION

I. Field of the Invention

The invention relates to an apparatus for the slicing of food products, in particular ham, sausage, bacon, cheese and the like in accordance with the preamble of claim 1. An apparatus having the features of the preamble of claim 1 is known from EP 1 020 260 A2.

II. Description of Related Art

In further known apparatuses for the slicing of food products, which are also called slicers and which work at a high cutting speed, adjustment possibilities must be provided, in particular in the product supply system, in order to be able to set the relative position between the product, the blade and the cutting edge in the best possible manner in dependence on the respective product to be cut up, in particular in dependence on the product size. Relatively complex setting processes and correspondingly designed product supply systems are required for this purpose.

BRIEF SUMMARY OF THE INVENTION

It is the object of the present invention to develop the apparatus of the initially named kind such that the described disadvantages are eliminated and simplified possibilities for the optimum slicing of different products are provided.

This object is substantially satisfied in accordance with the invention in that the adjustment device includes a frame having horizontal carriers and vertical carriers and being movable in the y direction along the machine housing and being arranged movably in the x direction at the cutting head housing.

It is achieved by the possibility provided in accordance with the invention of the precise adjustment of the total cutting head housing, i.e. the adjustment which can be carried out with very high accuracy and guiding stability, that every desired position of the blade or of the cutting circle of the blade is quickly and precisely settable with respect to the cutting edge. At the same time, this means that a standard product supply system can be worked with and no product dependent adjustment processes have to be carried out on the product supply side, since the respectively optimum position of the cutting circle of the blade can be achieved with respect to the cutting edge or to the product space associated with it in a simple manner by a sole adjustment of the cutting head housing in the X and/or Y direction in dependence on the respective product to be sliced and its position in the product space of the product supply system.

The adjustment of the cutting head housing preferably takes place via high precision spindles, and indeed either manually or via correspondingly suitable control units which permit automation.

The adjustment of the cutting head housing takes place in particular also possible to change the setting in dependence on the product during the slicing process.

Setting or adjustment processes can be omitted both on the product supply side and on the product take-away side due to the possibility existing on the basis of the invention of freely selecting the immersion angle of the blade into the respective product and of adjusting the relative position between the blade cutting circle and the cutting edge as desired, i.e. a standardization of both the product supply system and of the take-away system 7 or of the take-away belts is possible. Since the immersion angle of the blade into the product is decisive for the flight path of the slices formed and thus also for the portion forming on the belt arranged downstream of the cutting station, it can be achieved by the adjustment of the blade or of the cutting head housing that optimum portion formations or stack formations are obtained without any changing of the position of take-away belts. It is furthermore important in this connection that an image detection system 8 or a camera can be provided for the monitoring of the portion formation and/or of the stack formation, with the adjustment device being able to be correctively controlled in dependence on deviations from pre-determined portion and/or stack configurations by camera signals or by camera signals processed in the required manner.

A scythe-like blade is preferably used as the blade and it is also generally possible to design the adjustment device such that the blade or cutting head housing can be moved over short distances in the Z direction to carry out blank cuts in this manner.

BRIEF DESCRIPTION OF THE SEVERAL VIEWS OF THE DRAWINGS

An embodiment of the invention is described in the following with reference to the drawing, with the very schematically shown elementary representations of FIGS. 1 to 4 showing different relative positions of the blade cutting circle with respect to the cutting edge or to the product space.

DETAILED DESCRIPTION OF THE INVENTION

Figure 1:
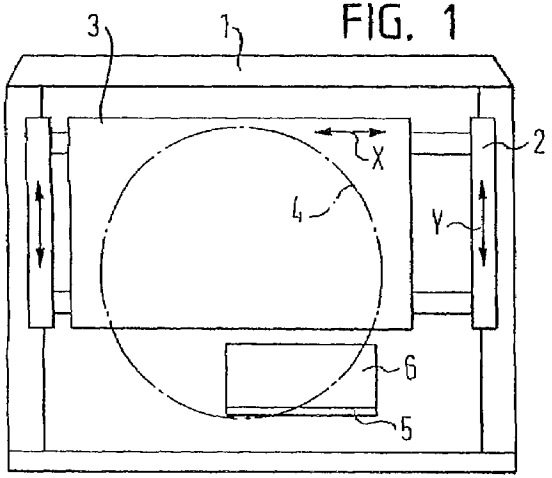
Figure 2:
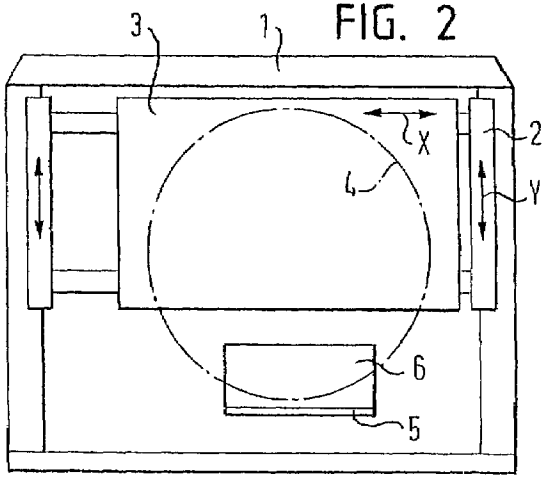
Figure 3:
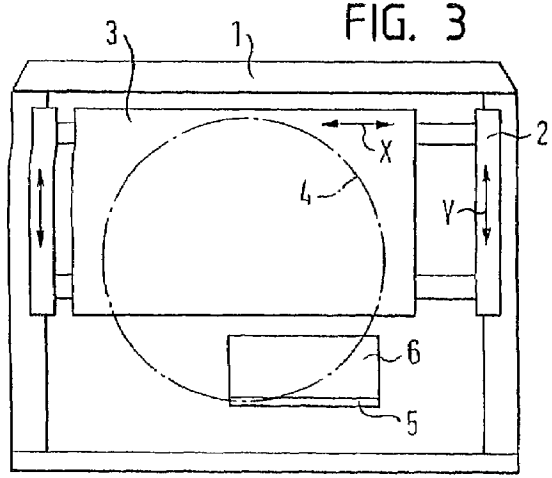
Figure 4:
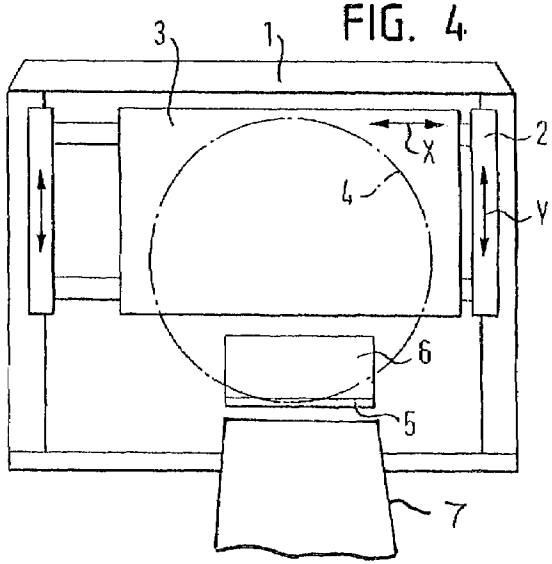

FIG. 1 shows in a schematic manner a machine housing 1, an adjustment device 2 attached to the machine housing and a cutting head housing 3 connected to the adjustment device 2, with the cutting circle of the scythe-like blade of the cutting head used being marked by 4.

The adjustment device 2 is formed by a precision carriage arrangement which permits a movement of the cutting head housing 3 in the X direction and in the Y direction. Setting spindles which are manually or automatically actuable are preferably provided to carry out these movements.

The product supply system belonging to the total apparatus and a portion forming system and product take-away system as a rule consisting of controlled belts are not shown in detail. These systems can be made in a conventional manner, with it being important in the already mentioned manner within the framework of the invention that standard systems can be used without complex setting and adjustment possibilities both on the product supply side and on the product take-away side in connection with the adjustable cutting head housing.

Furthermore, the cutting edge provided at the end of the product supply system and the product space 6 associated with this cutting edge 5 are shown schematically in FIG. 1. The cutting edge 5 defines the cutting plane in which the blade revolves. The respective product to be sliced or the respective products to be optionally sliced simultaneously can be arranged positioned differently inside the product space 6.

As can clearly be seen from FIGS. 1 to 4, it is possible via the adjustment device 2, in the form of a precision carriage arrangement, which supports the cutting head housing 3 to adjust the cutting head housing 3 or the position of the blade relative to the cutting edge 5 by an adjustment in the X and Y direction such that the blade cutting circle adopts practically any desired pre-settable positions relative to the cutting edge 5 or to the product space 6.

The corresponding adjustment can be made in dependence on the product prior to the start of a slicing process, but it is also possible to change the setting during the slicing process in dependence on cutting results and/or on measured values obtained during the cutting process. For example, the cutting capability of the product can be taken into account in this process and any changes of consistency of the product can be considered.

I claim:

1. An apparatus for the slicing of food products, comprising a machine housing, a product supply system with a cutting edge provided at one end and a cutting head housing with a rotatably driven cutting blade revolving in a cutting plane defined by the cutting edge, the cutting plane being perpendicular to the direction of movement of food product in the product supply system, wherein there is provided, between the cutting head housing (3) and the machine housing (1), an adjustment device (2) by means of which pre-adjustable settings of the cutting position of a cutting circle (4) of the cutting blade in mutual perpendicular X and/or Y directions relative to the cutting edge (5) can be carried out at least in the cutting plane defined by X and Y coordinates, wherein, for carrying out said settings, the cutting head housing (3) can make movements in the X and Y directions for subsequent cutting operations, wherein the adjustment device (2) includes a frame having a pair of horizontal carriers and a pair of vertical carriers and being linearly movable in the Y direction along the machine housing (1), and the cutting head housing (3) being mounted on the pair of horizontal carriers and linearly movable along the pair of horizontal carriers in the X direction to a cutting position which remains stationary during subsequent cutting operations, and wherein a rotational axis of the rotatably driven cutting blade is perpendicular to a plane defined by said X and Y directions.

2. An apparatus in accordance with claim 1, characterized in that the adjustment of the cutting head housing (3) takes place in dependence on the height and/or width of the respective product and/or on the product consistency and/or on the number of products to be sliced simultaneously and/or on the product type.

3. An apparatus in accordance with claim 1, characterized in that both the product supply system (5, 6) and a system (7) arranged downstream of the cutting station for forming portions and/or for the transporting away of the sliced products, in each case in a standard version with basic settings independent of the product, are associated with the cutting station with the adjustable cutting head housing (3).

4. An apparatus in accordance with claim 3, characterized in that the movement path of the sliced products between the cutting plane and the product take-away system is pre-settable by adjustment of the cutting head housing (3).

5. An apparatus in accordance with claim 4, characterized in that, for the monitoring of the portion formation and/or of the stack formation, an image detection system is provided; and in that the adjustment device (2) is correctively controlled continuously or discontinuously by the image detection system in dependence on deviations from the pre-determined portion configurations and/or stack configurations.

6. An apparatus in accordance with claim 1, characterized in that the blade consists of a scythe-like blade.

7. An apparatus for the slicing of food products, comprising a machine housing, a product supply system with a cutting edge provided at one end and a cutting head housing with a rotatably driven cutting blade revolving in a cutting plane defined by the cutting edge around a predetermined axis, the cutting plane being perpendicular to the direction of movement of food product in the product supply system, wherein there is provided, between the cutting head housing (3) and the machine housing (1), an adjustment device (2) by means of which pre-adjustable settings of the cutting position of a cutting circle (4) of the cutting blade in mutual perpendicular X and/or Y directions relative to the cutting edge (5) can be carried out at least in the cutting plane defined by X and Y coordinates, wherein, for carrying out said settings, the cutting head housing (3) can make movements in the X and Y directions for subsequent cutting operations, wherein the adjustment device (2) includes a frame having a pair of horizontal carriers and a pair of vertical carriers and being linearly movable in the Y direction along the machine housing (1), said horizontal carriers and said vertical carriers lying in parallel planes and the cutting head housing (3) being mounted on the pair of the horizontal carriers and linearly movable along the pair of horizontal carriers in the X direction so that said predetermined axis is perpendicular to said parallel planes, and wherein a rotational axis of the rotatably driven cutting blade is perpendicular to a plane defined by said X and Y directions.

8. An apparatus in accordance with claim 7, characterized in that the adjustment of the cutting head housing (3) takes place in dependence on the height and/or width of the respective product and/or on the product consistency and/or on the number of products to be sliced simultaneously and/or on the product type.

9. An apparatus in accordance with claim 7, characterized in that both the product supply system (5, 6) and a system (7) arranged downstream of a cutting station for forming portions and/or for the transporting away of the sliced products, in each case in a standard version with basic settings independent of the product, are associated with the cutting station with the adjustable cutting head housing (3).

10. An apparatus in accordance with claim 9, characterized in that the movement path of the sliced products between the cutting plane and the product take-away system is pre-settable by adjustment of the cutting head housing (3).

11. An apparatus in accordance with claim 10, characterized in that, for the monitoring of the portion formation and/or of the stack formation, an image detection system is provided; and in that the adjustment device (2) is correctively controlled continuously or discontinuously by the image detection system in dependence on deviations from the pre-determined portion configurations and/or stack configurations

12. An apparatus in accordance with claim 7, characterized in that the blade consists of a scythe-like blade.

* * * * *